US010866045B2

(12) United States Patent
Schumacher et al.

(10) Patent No.: US 10,866,045 B2
(45) Date of Patent: Dec. 15, 2020

(54) HOUSING FOR A CARTRIDGE MAGAZINE FOR A FIREARM AND CARTRIDGE MAGAZINE FOR A FIREARM

(71) Applicant: SCHMEISSER GmbH, Krefeld (DE)

(72) Inventors: Andreas Schumacher, Krefeld (DE); Thomas Hoff, Krefeld (DE); Olexy Pshemetsky, Krefeld (DE)

(73) Assignee: Schmeisser GmbH, Krefeld (DE)

( * ) Notice: Subject to any disclaimer, the term of this patent is extended or adjusted under 35 U.S.C. 154(b) by 0 days.

(21) Appl. No.: 16/549,402

(22) Filed: Aug. 23, 2019

(65) Prior Publication Data

US 2020/0011624 A1 Jan. 9, 2020

Related U.S. Application Data

(63) Continuation of application No. PCT/EP2018/000558, filed on Dec. 13, 2018.

(30) Foreign Application Priority Data

Jan. 30, 2018 (DE) ..... 10 2018 000 740

(51) Int. Cl.
*F41A 9/69* (2006.01)
*F41A 9/68* (2006.01)

(52) U.S. Cl.
CPC . *F41A 9/69* (2013.01); *F41A 9/68* (2013.01)

(58) Field of Classification Search
USPC ..... 42/50
See application file for complete search history.

(56) References Cited

U.S. PATENT DOCUMENTS 2,217,848 A * 10/1940 Schillström ..... F41A 9/69 42/50
4,428,137 A 1/1984 Johnson
(Continued)

FOREIGN PATENT DOCUMENTS

DE 34 22 334 A1 12/1985

OTHER PUBLICATIONS

Notice of Transmission of the International Research Report and the Written Notice Issued the International Searching Authority or Declaration dated Jun. 13, 2019 for International Application No. PCT/EP2018/000558 (13 pages).
(Continued)

*Primary Examiner* — Bret Hayes
(74) *Attorney, Agent, or Firm* — Taylor IP, P C.

(57) ABSTRACT

A housing for a cartridge magazine for a firearm including an interior space consisting of a first and a second region. Between the first and the second region a transitional region is formed which connects the first and second region with one another. The inside surface of the front wall extends in the direction of the Z-axis in at least one region along a first circular path, the inside surface of the rear wall extends in at least one region in the direction of the Z-axis along a second circular path. The first region is designed for accommodation of four stacks of cartridges arranged directly adjoining one other and preferably offset in Z-direction relative to one another. The second region being designed for accommodation of two stacks of cartridges arranged directly adjoining one another and preferably offset in Z-direction relative to one another.

19 Claims, 6 Drawing Sheets

(56) References Cited

U.S. PATENT DOCUMENTS

| | | | | |
|---|---|---|---|---|
| 4,589,218 | A | 5/1986 | Teppa | |
| 8,061,071 | B2 | 11/2011 | Fitzpatrick et al. | |
| 8,365,454 | B2 | 2/2013 | Hogan, Jr. | |
| 2010/0269389 | A1* | 10/2010 | Lopez Laparra | F41A 9/68 42/49.01 |
| 2010/0281737 | A1* | 11/2010 | Cahill | F41A 9/65 42/50 |
| 2012/0066950 | A1* | 3/2012 | Davidson | F41A 9/69 42/50 |
| 2012/0131831 | A1 | 5/2012 | Sullivan et al. | |
| 2013/0180146 | A1* | 7/2013 | Fitzpatrick | F41A 9/70 42/50 |
| 2014/0053446 | A1 | 2/2014 | Sullivan | |

OTHER PUBLICATIONS

German Office Action dated Sep. 26, 2018 for German Application No. 10 2018 000 740.6 (6 pages).

* cited by examiner

HOUSING FOR A CARTRIDGE MAGAZINE FOR A FIREARM AND CARTRIDGE MAGAZINE FOR A FIREARM

CROSS REFERENCE TO RELATED APPLICATIONS

This is a continuation of PCT application No. PCT/EP2018/000558, entitled "HOUSING FOR A CARTRIDGE MAGAZINE FOR A HANDGUN AND CARTRIDGE MAGAZINE FOR A HANDGUN", filed Dec. 13, 2018, which is incorporated herein by reference.

BACKGROUND OF THE INVENTION

1. Field of the Invention

The invention relates to a housing for a cartridge magazine for a firearm, and more particularly to a stack-type magazine.

2. Description of the Related Art

Cartridge magazines for firearms have been known for a long time and, according to the current state of the art are manufactured in various designs. The expert distinguishes between cartridge magazines which are firmly connected with the firearm and those which can be repeatedly connected with the firearm in a rapid manner through releasing of a retaining mechanism. The latter cartridge magazines which are also referred to as a cartridge plug in magazines are known in particular as drum magazines and stack-type magazines. In a stack-type magazine the cartridges are stored in such a manner that, at least in a partially filled cartridge magazine, they touch each other tangentially at their casing walls inside the housing of the cartridge magazine.

Depending on whether the stack-type magazine is designed as a single or multi row magazine, the contact points or respectively the contact lines of the cartridges shift between one another.

In particular for use by authorities, but also for sporting applications it is often desirable to equip a firearm with a suitable cartridge magazine that provides high fire power. This is understood to be the ability to fire a high number of shots within a short time. Since the exchange of a cartridge magazine, depending on the design of the retaining mechanism and the skill of the operator, requires a certain time, for example 2 to 4 seconds, the endeavor is to make the holding capacity of an individual cartridge magazine as large as possible. In conflict thereto; however, is the manageability of the cartridge magazine for the operator who needs to carry the cartridge magazine apart from the firearm, as a spare magazine, which must be co-designed manageable for the operator even in stress situations and which does not reduce the manageability of the firearm with the inserted cartridge magazine, or at least reduces it to the least possible degree.

One firearm used worldwide for decades by authorities represents a self-loading gun according to prototype AR—15/A 16. For a repeatable detachable connection of cartridge plug-in magazines with the firearm, the gun including a magazine slot that is open toward the bottom into which suitable cartridge magazines can be inserted. Cartridge magazines with different capacities are known for this purpose. For the operation of this weapon or generically similar firearms, magazines with a capacity of 20 or 30 cartridges are currently in use. Under a generically similar firearm a self-loading gun is to be understood which offers the operator a choice between a first mode of operation wherein the weapon can be operated such that a single actuation of its trigger always releases a single shot, and a second mode of operation wherein the weapon is operated such that a single actuation of its trigger always releases a plurality of shots. In connection with the prior description, the generic similarity of the described firearm is to be maintained also if the operator when selecting a plurality of shots to be fired, can in addition also select again between firing a closed group of shots, for example a 3 or a 5 shot burst or continuous sustained fire.

As to how fast successively the shots are delivered by the firearm after a single activation of the trigger when selecting an automatic sequence is referred to as cadence. The cadence of a currently standard firearm of the described type is usually between 600 shots per minute and approx. 1200 shots per minute.

On the basis of an average cadence of 900 shots per minute, a 20 shot magazine will be emptied in 1.33 seconds. In contrast, a 30 shot magazine holds exactly 2 seconds. If one assumes that a magazine change can be performed in 3 seconds, even under operating conditions, the firearm achieves an operating efficiency of approximately 40%. In comparison, with a 60 shot magazine under otherwise the same conditions it achieves an operating efficiency of approximately 58% and thus experiences an increase of almost 50%.

Unfortunately, for various reasons, the knowledge gained from the manufacture of cartridge magazines with a 20 or 30 shot capacity can be transferred only to a very limited degree to the manufacture of such high capacity magazines, for example 60 shot magazines. In spite of the long-recognized requirement for high capacity stack-type magazines, high capacity magazines are currently offered almost exclusively as drum magazines. However, drum magazines are very disadvantageous for carrying along and handling by the operator of the firearm.

A cartridge magazine in the embodiment of a stack-type magazine is known from U.S. Pat. No. 8,061,071 B2 which has a capacity of 60 cartridges.

Such a magazine increases the efficiency of a firearm associated therewith substantially compared to the 20 or 30 cartridge capacity magazines, since a magazine change during a time where the firearm is not operational and during which time its operator is also defenseless only becomes necessary after a duration of double or three times the operating time.

What is needed in the art is an alternative to the housing known from U.S. Pat. No. 8,061,071 B2 for a cartridge magazine and the therein disclosed cartridge magazine. Various disadvantages have surfaced during longer use of the housing and the magazine. The cartridge magazine is furthermore vulnerable to dirt, wear and prone to failure. The housing moreover withstands pressure upon the inside side surfaces only to a limited extent. It is therefore a particular objective of the invention to overcome these and other disadvantages.

SUMMARY OF THE INVENTION

The present invention relates to a housing for a cartridge magazine for a firearm, which extends along an X-axis, a Y-axis and a Z-axis and which, in its inside forms an interior space consisting of a first and a second region, wherein between the first and the second region a transitional region is formed which connects the first and second region with one another, wherein the interior space is limited by the inside surfaces of a front wall, a rear wall, a first side wall and a second side wall, wherein the inside surface of the front wall extends in the direction of the Z-axis in at least one region along a first circular path, wherein the inside surface of the rear wall extends in at least one region in the direction of the Z-axis along a second circular path and wherein the inside surfaces of the front wall and the rear wall in this at least one region are located at a distance A from one another, wherein the cartridge magazine moreover includes a bottom cover which is suitable to at least substantially close off the at least partially open bottom side of the housing, including a first and a second feeder which are designed such that the second feeder is movable at least partially into the space of the first feeder, a first spring which is located between the first feeder and the bottom cover, and a second spring which is located between the first and the second feeder.

Further, the present invention relates to a method for operating a firearm by using a cartridge magazine.

At least part of the invention objectives are solved for a housing in that the first region is designed for accommodation of four stacks of cartridges arranged directly adjoining one other and preferably offset in a Z-direction relative to one another, and that the second region is designed for accommodation of two stacks of cartridges arranged directly adjoining one another and preferably offset in the Z-direction relative to one another.

Due to the fact that the cartridge stacks in the first region and in the second region are arranged directly adjoining one another, the housing can be designed as especially streamlined which greatly improves handling of a cartridge magazine with such a housing.

The cartridges are arranged directly adjoining one another because they also directly touch each other, at least in partial areas of their shell surfaces. Since, in a cartridge magazine for a firearm only one cartridge is removed at the magazine lips, the cartridges must be arranged such, that at any one time only one single cartridge can fit with its shell surface against at least one of the two magazine lips. Therefore, if one region has a space for more cartridge stacks than another region, the individual cartridges of the cartridge stacks must roll down—quasi like in a zipper system on their shell surfaces, one below the other in the transitional region that is arranged between them. If however, a partition wall is provided this process is impaired. Subsequently, individual cartridges are transported at different speeds in the direction of the magazine lips. Here, outright velocity jumps occur. Individual cartridges temporarily loose guidance because of their neighboring cartridges. During subsequent sliding the shell surfaces of the cartridges collide with each other. Such processes are difficult to calculate and, especially in high frequency operation of a firearm can clearly increase its susceptibility to failure. A cartridge magazine that includes a partition wall does not provide suitable repetitive accuracy of a movement process for the cartridges contained therein in their movement in the direction of the magazine lips and is thus suitable for use only to a limited extent. Due to the fact that the first region is designed for accommodation of four stacks of cartridges arranged directly adjoining one other and preferably offset in the Z-direction relative to one another, and that the second region is designed for accommodation of two stacks of cartridges arranged directly adjoining one another and preferably offset in the Z-direction relative to one another, repetitive accuracy of a movement process of all cartridges that are located in the magazine and that during operation are removed successively at the magazine lips is ensured. Smooth rolling off of the cartridges at their shell surfaces one below the other is thus ensured.

Due to no impacts on the shell surfaces between the cartridges, considerably lower shear forces occur, which act from the inside upon the side surfaces, it was surprisingly shown that the wall thicknesses of an inventive housing for a cartridge magazine do not have to differ substantially from the wall thicknesses of conventional cartridge magazines and their housings with clearly lesser capacity.

In order to be able to ensure smooth operation and repetitively accurate process sequence during the progressive advancement of the cartridges in the interior space of the housing/cartridge magazine it is provided especially advantageously that cartridges P in all regions of the housing are arranged directly adjacent to one another.

At least part of the objectives are solved for a housing of the type discussed at the beginning in that the first region is designed for accommodation of four stacks of cartridges arranged directly adjoining one other and preferably offset in the Z-direction relative to one another, and that the second region is designed for accommodation of two stacks of cartridges arranged directly adjoining one another and preferably offset in the Z-direction relative to one another.

Due to the fact that the cartridge stacks in the first region and in the second region are arranged directly adjoining one another, the housing can be designed especially streamlined which greatly improves handling of a cartridge magazine with such a housing.

Since, in a cartridge magazine for a firearm only one cartridge is removed at the magazine lips, the cartridges must be arranged such, that at any one time only one single cartridge can fit with its shell surface against at least one of the two magazine lips. Therefore, if one region has space for more cartridge stacks than another region, the individual cartridges of the cartridge stacks must roll down—quasi like in a zipper system—on their shell surfaces, one below the other in the transitional region that is arranged between them. If however, a partition wall is provided this process will be impaired. Consequently, individual cartridges are transported at different speeds in the direction of the magazine lips. Here, outright velocity jumps occur. Individual cartridges temporarily loose guidance because of their neighboring cartridges. During subsequent sliding the shell surfaces of the cartridges collide with each other. Such processes are difficult to calculate and, especially in high frequency operation of a firearm can clearly increase its susceptibility to failure. A cartridge magazine that includes a partition wall does not provide suitable repetitive accuracy of a movement process for the cartridges contained therein in their movement in the direction of the magazine lips and is thus suitable for use only to a limited extent. Due to the fact that the first region is designed for accommodation of four stacks of cartridges arranged directly adjoining one other and preferably offset in the Z-direction relative to one another, and that the second region is designed for accommodation of two stacks of cartridges arranged directly adjoining one another and preferably offset in the Z-direction relative to one another, repetitive accuracy of a movement process of all cartridges that are located in the magazine and that during operation are removed successively at the magazine lips is ensured. Smooth rolling off of the cartridges at their shell surfaces one below the other is thus ensured.

Since, there are no impacts on the shell surfaces between the cartridges, considerably lower shear forces occur, which act from the inside upon the side surfaces, it was surprisingly shown that the wall thicknesses of an inventive housing for a cartridge magazine does not have to differ substantially from the wall thicknesses of conventional cartridge magazines and their housings with clearly lesser capacity.

At least part of the objectives are solved for a housing of the type discussed at the beginning in that the cartridge magazine includes a locking piece which is arranged as being movable relative to the housing of the cartridge magazine and which can be moved by the feeder that is movable through the second region into a free space that is arranged in the housing in the rear wall between the magazine lips.

The locking piece is advantageously suitable for limiting a freedom of movement of the lock of a firearm. The locking piece is moreover advantageously formed by a bent metal piece which is arranged supported movably on the inside and the outside of the rear wall. The bent metal piece consists very advantageously of an especially hardened and tempered spring steel. It is moreover advantageous if the metal piece has an angular deflection of approximately 90 degrees between two approximately 180 degree angular deflections.

The cartridge magazine according to the present invention can be designed advantageously with the advantageous design properties of the housing for the cartridge magazine. In regard to an economical description and in order to avoid repeats, the design possibilities and their advantages will be described below for both subjects at the same time, either exemplifying the housing or the cartridge magazine. Even if no reference is made to the other subject the expert will know that the advantages described in this context are transferable to the other inventive subject respectively.

In a first advantageous design, the inside surface of the front wall has a first protrusion which protrudes in direction of the X-axis into the interior space of the housing and extends along the Z-axis originating from the transitional region at least also partially into the first region and at least also partially into the second region; and the inside surface of the rear wall has a second protrusion which protrudes in direction of the X-axis into the interior space of the housing and which along the Z-axis features a start in the first region and an end in the transitional region.

In this way, the order between the individual cartridges that are to be accommodated in the cartridge magazine can be improved. Because of the second protrusion, the cartridges can be somewhat spread apart at the back, due to which they can be easier aligned relative to one another at their front. This improves the mutual integration behavior of the individual cartridges during the reduction of the stacks in the magazine formed by the cartridges. The effect is especially powerful if the cartridges have a bottle-shaped sleeve/a bottle-shaped shell. The first protrusion and also the second protrusion are suited to guide the feeder or feeders of a cartridge magazine and contribute considerably to the stability of the housing.

The inside surfaces of the first side wall and the second side wall in the first region and in the second region are preferably arranged substantially parallel relative to one another and between them in Y-direction a virtual central plane is formed in the X- and Z-directions. In this manner a repetitively accurate process of the cartridge movement inside the housing/the cartridge magazine is additionally supported during operation.

It can furthermore be advantageous if the inside surfaces of the first side wall and the second side wall in the first region are located at a distance B and in the second region at a distance C from one another. It is herein very advantageous if distance B is 1.85 times to 2.15 times, in particular 1.95 times to 2.05 times that of distance C.

In this way the interior space of the housing/the cartridge magazine is especially advantageously utilized so that also the exterior dimensions can be designed to be especially compact. The cartridges moreover occupy a similar position in the first region and the second region which can clearly increase the functional safety of a firearm operated with a cartridge magazine designed in this manner.

It is preferred that the cross section of the first region extending along X-axis and Y-axis divides itself into a rectangular zone and into a trapezoid zone adjoining the rectangular zone and that the cross section of the second region extending along the X-axis and the Y-axis divides itself into a rectangular zone and into a trapezoid zone adjoining the rectangular zone. In this manner, the stability of the housing is strengthened.

Moreover, the previously cited effects, for example forcing slight tilting relative to each other of the cartridges in the cartridge magazine can be supported by means of the housing.

Furthermore, such a cross section will also satisfy cartridges having bottle-shaped silhouettes.

Handling of the cartridge magazine can also be improved if the outside shape of the housing/the cartridge magazine is based on this cross section. With such an arrangement, distance B and C always relates to the distance of the inside surfaces of the side walls in the rectangular zone.

It is ensured with significant advantage that the first protrusion is arranged at least in sections inside the central plane and/or the second protrusion is arranged at least in sections inside the central plane. The stability of the housing is thereby increased in an especially simple manner. Such an arrangement also promotes smooth operation when regrouping the cartridges from a four-stack arrangement into a two-stack arrangement inside the housing.

It is also preferred that the extension of the first protrusion in the X-direction is between 5% of A and 30% of A, in particular between 5% of A and 18% of A and especially between 8% of A and 13% of A and/or that the extension of the second protrusion in the X-direction is between 5% of A and 30% of A, in particular between 5% of A and 18% of A and especially between 8% of A and 13% of A. The protrusions therefore point towards each other in the interior space of the housing.

During trials, these values showed surprisingly good results in regard to functional safety of the cartridge magazine and of a firearm operated with a cartridge magazine of this design, as well as stability of the housing of the cartridge magazine.

Cartridge magazines of this design moreover proved to be especially resistant to contamination and could maintain their complete functional safety even under extreme contamination.

Merely as an example, the cited conditions can one more time be more clearly explained with a non-conclusive numerical example. With a distance A of 58 mm, the extension of the first protrusion in the X-direction is, for example, between 3.0 mm and 18.0 mm, in particular between 4.0 mm and 10.0 mm and especially between 5.0 mm and 8.0 mm and/or the extension of the second protrusion in the X-direction is for example between 3.0 mm and 18.0 mm, in particular between 4.0 mm and 10.0 mm and especially between 5.0 mm and 8.0 mm. Distance A can assume any desired value between 18.0 mm and 130 mm, wherein a value of between 30.0 mm and 90.0 mm is preferred. The inside surface of the rear wall has preferably at least two grooves in at least one region, each of which progress laterally, preferably directly adjacent to the second protrusion. In this manner an especially stable guidance of the feeder is made possible if the feeder is shaped accordingly. This type of design also increases dirt resistance of the housing/cartridge magazine.

The extension of the two grooves in the X-direction can, for example, be between 2% of A and 9% of A, in particular between 3% of A and 8% of A and especially between 4% of A and 6% of A. Material recesses surprisingly even increase the rigidity of the housing/cartridge magazine in this region.

It is advantageous if the inside surface of the first side wall has an additional protrusion which protrudes in direction of the Y-axis into the interior space of the housing and which along the Z-axis starts in the first region and ends in the transitional region and/or if the inside surface of the second side wall has an additional protrusion which protrudes in direction of the Y-axis into the interior space of the housing and which along the Z-axis starts in the first region and ends in the transitional region.

In this manner the cartridge feeder or feeders and/or cartridges can also be guided laterally thereby once more reducing the risk of misalignment of a cartridge and/or a cartridge feeder and a possible malfunction of the cartridge magazine arising therefrom. Such protrusions also increase the rigidity and stability of the housing.

In addition, an important advantage results from the fact, that the cartridges are then guided with very low friction at the relatively narrow front regions of the protrusions. In addition, the frictional resistance experienced by the cartridges and/or the cartridge feeders on their path with main direction along the Z-axis and toward the magazine lips, remains always approximately identical from practically clean cartridge magazine or housing to heavily contaminated cartridge magazine or housing condition so that the desired repetitive accuracy in the operation of the firearm can be maintained regardless of the level of contamination.

It can be an additional advantage if the additional protrusion or protrusions are arranged in an interface region between the rectangular zone and the trapezoid zone adjoining the rectangular zone of the cross section of the first region.

Surprisingly it has been shown that it is advantageous to support the cartridge feeder or feeders and/or the cartridges laterally with only a single protrusion, wherein it is advantageous if the protrusion is located at a distance of approximately 0.65 times distance A to 0.85 times distance A from the inside surface of the rear wall.

An advantageous arrangement results if the inside surface of the first side wall is designed to be in the transitional region along a first curved path and the inside surface of the second side wall is designed to be in the transitional region along a second curved path, wherein the curved paths each comprise a turning point and extend from the bottom side of the housing to the top side of the housing before the respective turning point in direction of the central plane and position themselves firmly after the respective turning point against a first and a second parallel relative to the central plane. In this manner, an especially smooth guidance of cartridges and/or cartridge feeders is achieved. This contributes considerably to a stable, in other words defined and repetitively accurate operation.

It can herein be especially advantageous if the curved paths are designed symmetrically identical. This meets the requirements very well of a symmetrically designed cartridge. In addition, it can also be advantageous if the first and the second curved path are arranged in the Z-direction offset relative to one another by an offset V. This favorably promotes smooth regrouping of the cartridges among each other. It is herein preferred if the offset V is between 7% and 35%, in particular between 10% and 25% and especially between 18% and 22% of the difference between distance B and distance C. In trials it was surprisingly shown that an offset within the specified value range promotes an especially trouble-free operation.

It is very advantageous if the housing is a single component. In this manner, the stability of the housing and an associated cartridge magazine is greatly increased. In addition, the inside and outside surfaces are customizable and interfering material overlaps can be avoided. The housing consists preferably of a homogeneous material, wherein the structure of the material is homogeneous over the entire housing. Also, brittleness caused perhaps through welding, can be avoided. The material structure in the sense of the current invention is homogeneous even if the material is a reinforced material.

It is especially advantageous if the housing consists of a synthetic material. This enables the production of especially light weight and resistant housings. Especially preferred herein is the use of a polyamide (PA), in particular a reinforced polyamide or a polyether ether ketone (PEEK). To be able to achieve an especially inexpensive outcome, for example for so-called "single use cartridge magazines" polyethylene (PE) may for example be used.

In one method of operating a firearm when using a cartridge magazine, at least part of the underlying objective(s) of the current invention is met in that, in the operation of a firearm a cartridge magazine with a housing according to one of the claims is used.

The advantages resulting therefrom and during the use of advantageous arrangements of the invention were already described in the context of the inventive housing for a cartridge magazine and the cartridge magazine and apply analogously.

BRIEF DESCRIPTION OF THE DRAWINGS

The above-mentioned and other features and advantages of this invention, and the manner of attaining them, will become more apparent and the invention will be better understood by reference to the following description of an embodiment of the invention taken in conjunction with the accompanying drawings, wherein.

Corresponding reference characters indicate corresponding parts throughout the several views. The exemplifications set out herein illustrates one embodiment of the invention, in one form, and such exemplification is not to be construed as limiting the scope of the invention in any manner.

DETAILED DESCRIPTION OF THE INVENTION

Figure 1:
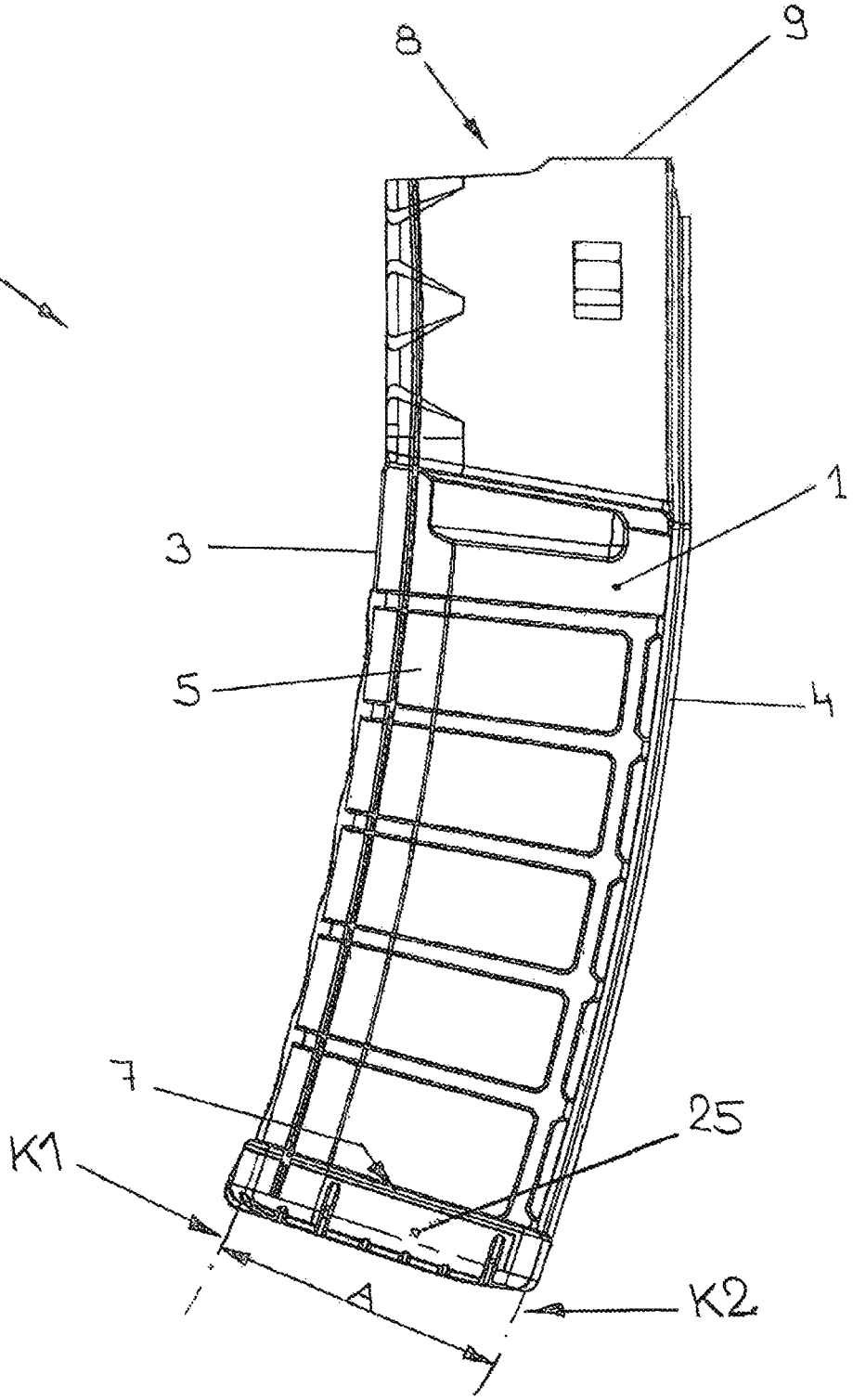
FIG. 1 illustrates a side view of a cartridge magazine according to an embodiment of the present invention with a housing.

The drawing of FIGS. 1-6 show a preferred design example of inventive cartridge magazine 2 which includes an inventive housing 1. Same components carry the same identification in all Figures and are not necessarily depicted or visible in all Figures or repetitively described in all Figures.

Figure 4:
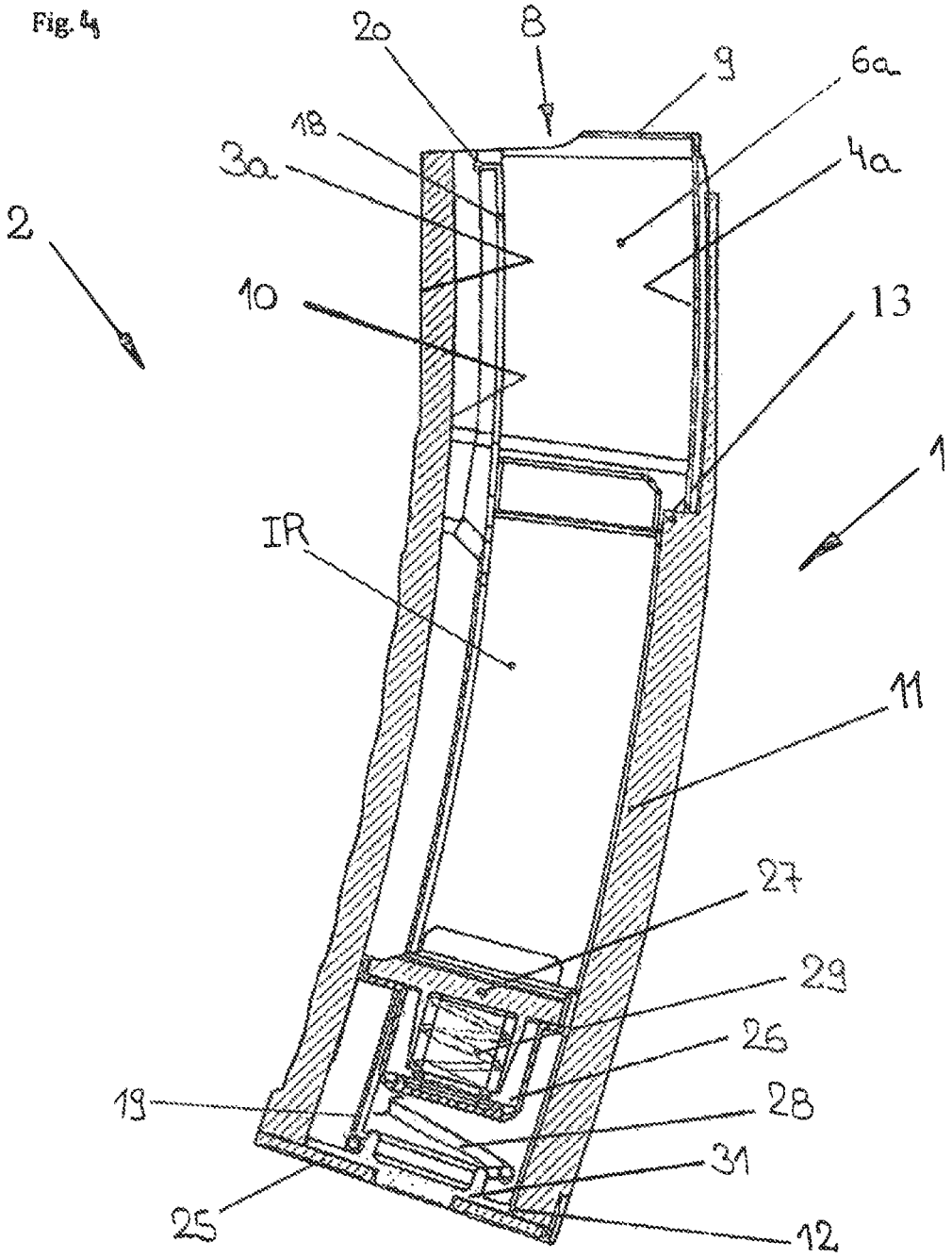
FIG. 4 is a sectioned side view taken along line M of FIG. 3.

FIG. 1 of the drawing shows cartridge magazine 2 in a side view from the outside. Front wall 3, rear wall 4 and first side wall 5 of housing 1 are clearly visible. A bottom cover 25 is fixed to the bottom side of housing 7. This can for example be slid open from front wall 3 in the direction of rear wall 4 in guide grooves provided in housing 1 for this purpose, and can, for example, be secured against loss by means of an inside bottom plate, illustrated in FIG. 4, by way of pressure by first spring 28 which is also shown in FIG. 4.

Figure 2:
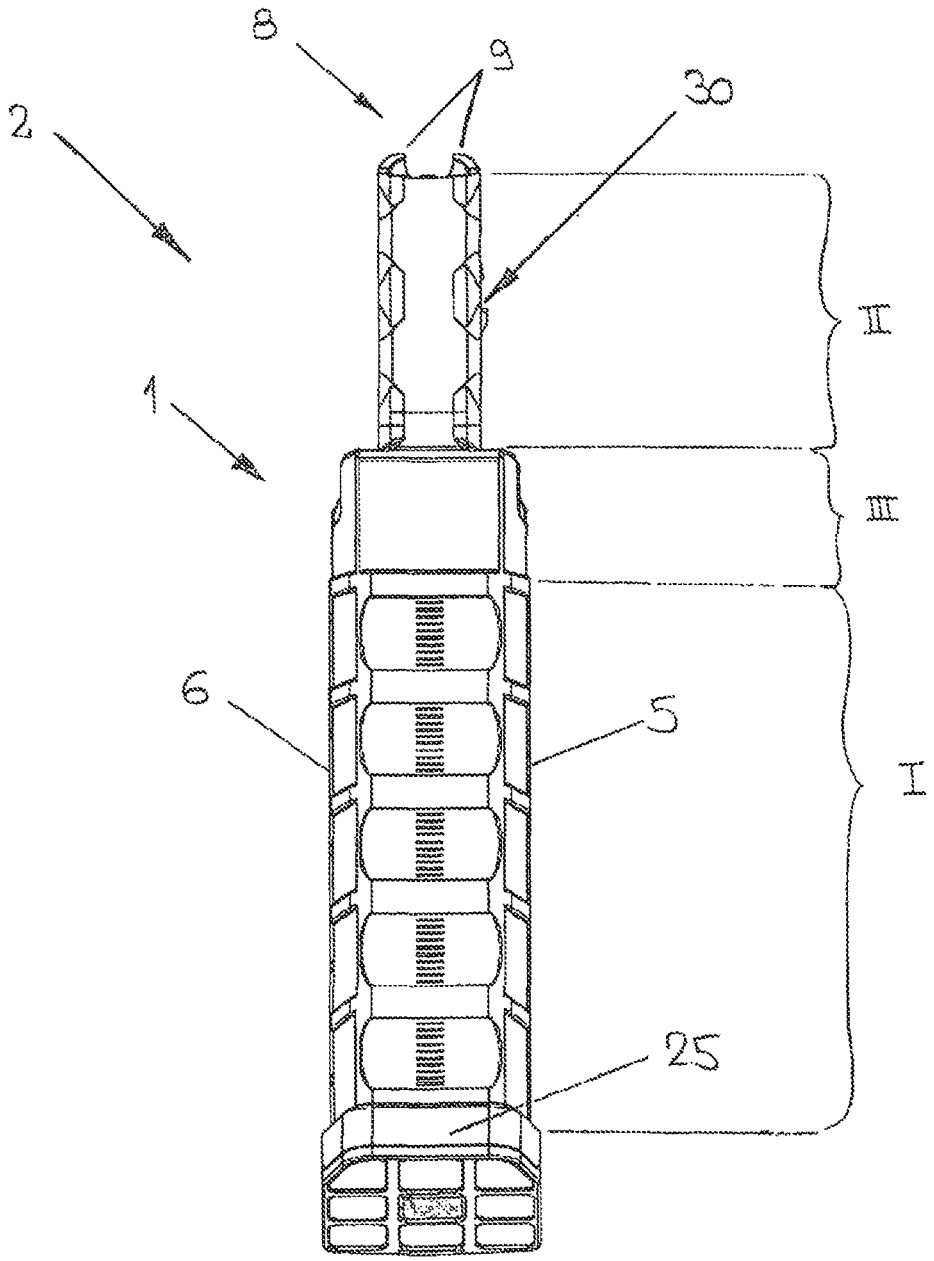
FIG. 2 is a front view of the cartridge magazine with housing that is illustrated in FIG. 1.
Figure 5:
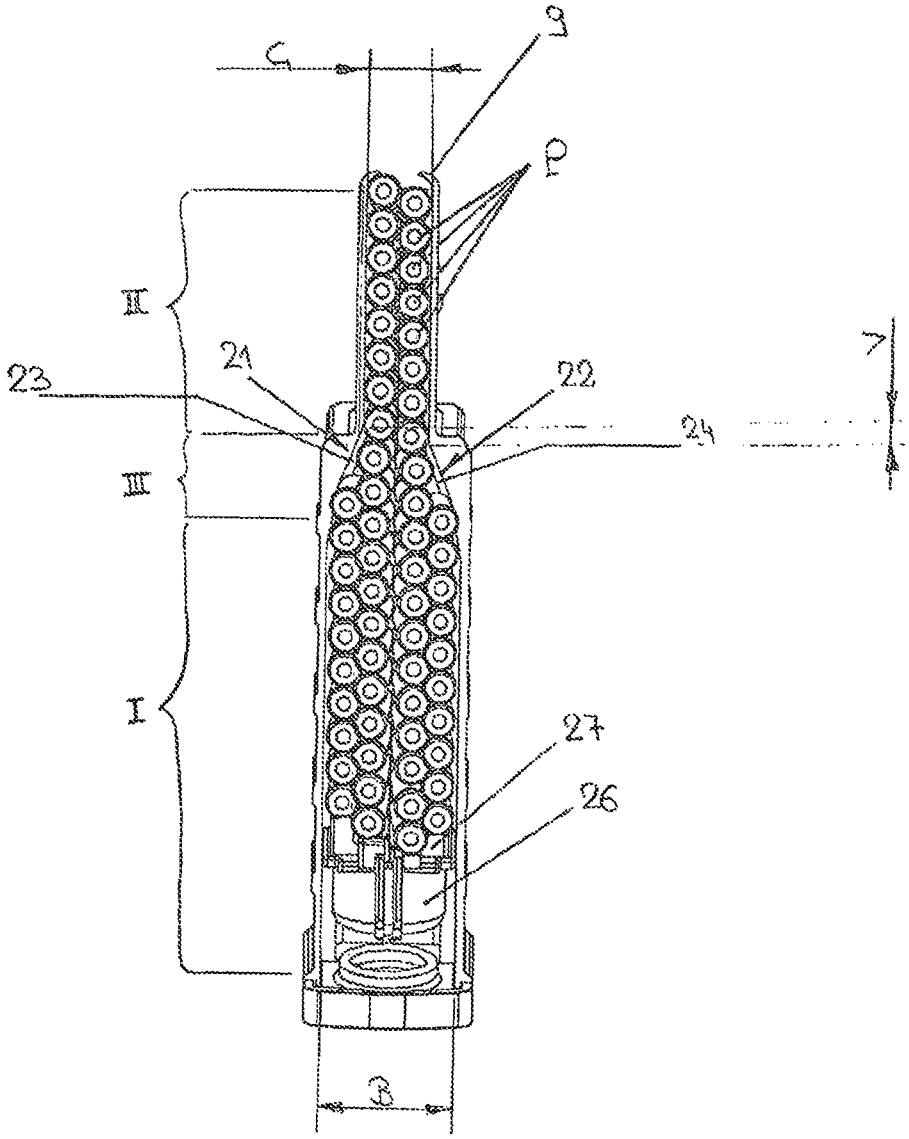
FIG. 5 is a rear view of the cartridge magazine in a sectional view partially filled with cartridges.

It is also visible that inside 3*a* of front wall 3 in at least in one of the regions I, II or III identified in FIGS. 2 and 5 progresses along a first circular path K1. In the illustrated example at least inside 3*a* of front wall 3 should actually be located in all regions I, II and III on first circular path K1. At a distance A thereto, inside 4*a* of rear side 4 extends in at least one region I, II, or III along a second circular path, wherein the radius of second circular bath K2 can be greater by A than the radius of first circular path K1. In the illustrated example, at least inside 4*a* of rear wall 4 should actually be located in all regions I, II, and III in second circular path K2. Housing 1 of the cartridge magazine features on its housing top side 8, magazine lips 9 which are designed to always support top cartridge P located in interior space IR (compare FIG. 4 and FIG. 6) in cartridge magazine 2 on its shell surface, at least in an at least partially filled state of the cartridge magazine. In a partially filled state the at least one cartridge P is pressed by means of spring force, in particular a spring force resulting from a first spring 28 and a second spring 29, against the inside of magazine lip 14 and can then during use of a firearm which is not illustrated here be moved from its lock forward, in other words in direction of the front wall and via same can be removed from cartridge magazine 2. Due to the easily recognizable shape in FIG. 2 of the two magazine lips 14, housing top side 8 is not further enclosed, but open.

Moreover, in the outside front view of cartridge magazine 2 illustrated in FIG. 2, second side wall 6 of housing 1 is visible in addition to first sidewall 5. Also the location of first region I and second region II, as well as that of transitional region III connecting the latter is recognizable. Locking section 30 which is located in region II is designed to form together with an appropriate counterpart a mechanism on the firearm for detachable mounting of the cartridge magazine in the intended firearm which however is not illustrated herein.

Figure 3:
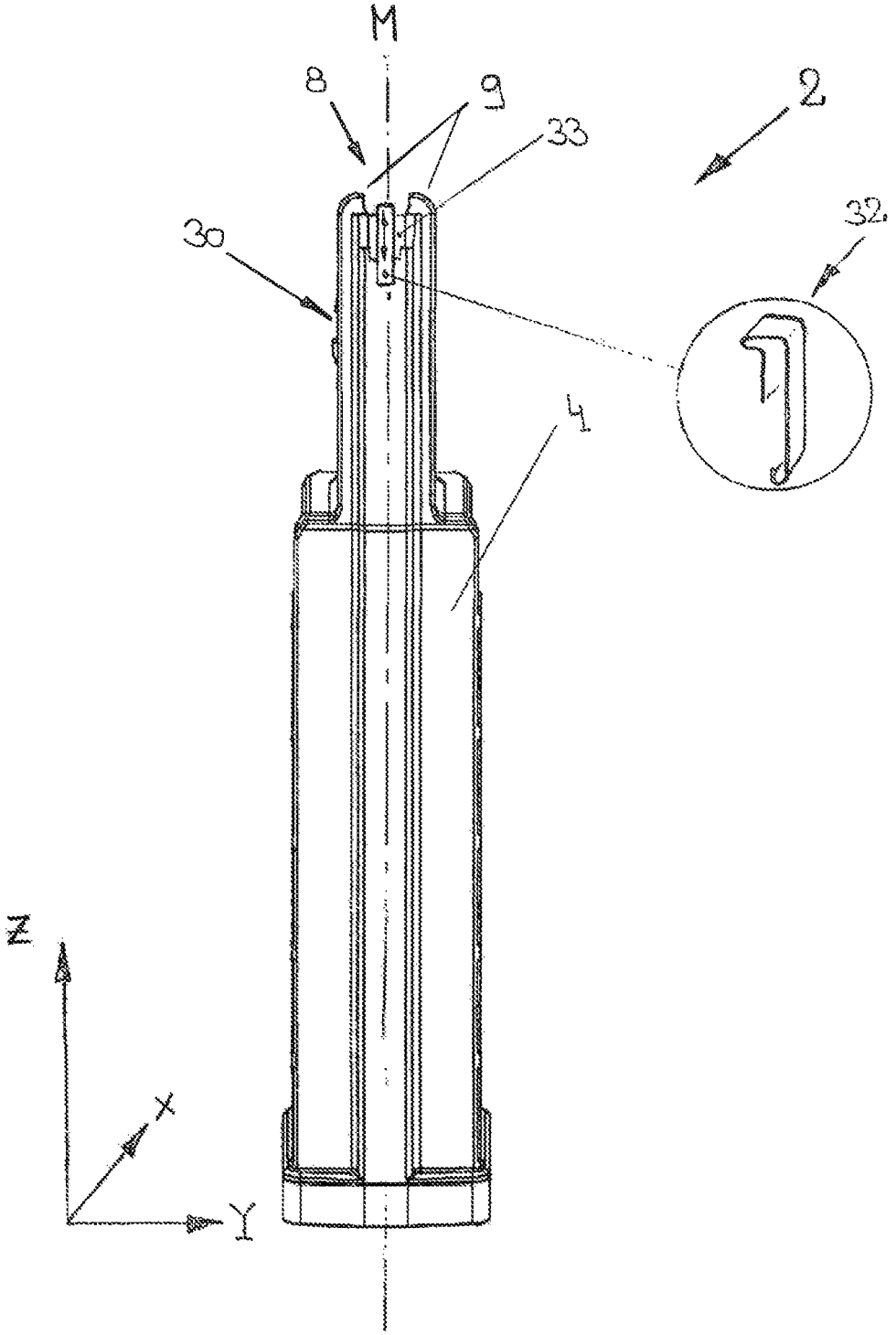
FIG. 3 is a rear view of the cartridge magazine with housing that is illustrated in FIGS. 1 and 2.

FIG. 3 shows a rear view of cartridge magazine 2, wherein rear wall 4 is clearly recognizable. The central plane extends through the longitudinal axis of the magazine in a Z-direction, wherein the central plane in the context of the description of the preferred design example is only illustrated in FIGS. 3 and 6, the same as other planes and components that are not illustrated in all Figures, but are included in the only design example illustrated in the drawing.

FIG. 3 also shows a cartridge magazine 2 with a locking piece 32 which is movably located opposite housing 1 of cartridge magazine 2 along the illustrated double arrow which can be moved by the feeder, movable through second region II into a free space 33 located in housing 1 in rear wall 4 between magazine lips 14. Locking piece 32 is suitable for limiting a freedom of movement of the lock on a firearm. Locking piece 32 is moreover formed by a bent metal piece which is arranged supported movably on inside 4*a* and the outside of rear wall 4. The bent metal piece consists very advantageously of an especially hardened and tempered spring steel. The enlarged perspective illustration showing the locking piece outside of the cartridge magazine shows an angular deflection of approximately 90 degrees between two approximately 180 degree angular deflections. The metal thickness is especially preferably between 0.8 mm and 1.6 mm. To be able to absorb the forces of the non-illustrated lock of the also non-illustrated firearm the locking piece preferably supports itself preferably also laterally on the edges of free space 33. Even through the locking piece is only depicted in FIG. 3 of the drawings, for reasons of a clear overview of the cartridge magazine, it can and should of course be present in all illustrated Figs.

FIG. 4 provides an insight into the interior space IR of cartridge magazine 2, so that inside surfaces 3*a*, 4*a* and 6*a* are clearly visible. First protrusion 10 and second protrusion 11 are shown in the crosshatched area. It can be clearly seen that inside surface 3*a* of front wall 3 has a first protrusion 10 which protrudes in direction of the X-axis (compare FIGS. 3 and 6) into inside space IR of housing 1, and which extents along the Z-axis originating from transitional region III at least partially into first region I and at least also partially into second region II; and that inside surface 4*a* of rear wall 4 has a second protrusion 11 which in direction of the X-axis protrudes into inside space IR of housing 1 and which along the Z-axis features a start 12 in first region I, here even close to housing bottom side 7, and an end 13 in transitional region III or in second region II, wherein end 13 is factually in transitional region III.

Start 19 and end 20 of additional protrusion 18 of inside surface 6*a* of second side wall 6 is also recognizable in the left area of the illustration. An additional protrusion 15 can also be provided in a symmetrically identically manner in the herein non-illustrated inside 5*a* of housing 1, as can also be seen in FIG. 6.

Second feeder 27 is pressed against the force of second spring 29 into the space of first feeder 26 which in the illustration is pressed deeply into the inside space of region I against the force of first spring 28. The first spring is arranged between first feeder 26 and bottom plate 25, even if in the illustrated example this is only indirectly the case, since here an inside bottom plate 31 is provided between first feeder 26 and bottom plate 25.

FIG. 5 shows the inventive cartridge magazine 2 in a sectional illustration of the rear view, partially loaded with cartridges P. Here it can be clearly seen that first region I is designed for accommodation of four stacks of cartridges P, which are arranged directly adjacent to one another and preferably offset relative to one another in the Z-direction; and that second region II is designed for accommodation of two stacks of cartridges P which are arranged directly adjacent to one another and preferably offset relative to one another in the Z-direction.

The cartridges are arranged directly adjacent to one another because they touch each other directly, at least in partial regions of their shell surfaces.

In order to be able to accommodate four stacks of cartridges arranged adjacent to one another (in the Y-direction, compare FIGS. 3 and 6)), inside surfaces 5*a* and 6*a* of first and second side wall 5 and 6 which are arranged parallel to one another assume a distanced B relative to one another in region I which, in the illustrated example is approximately 1.95 times to 2.05 times that of distance C of the side inside surfaces which are arranged parallel to one another in region II.

In order to ensure smooth operation and repetitively accurate process sequence during the progressive advancement of cartridges P in interior space IR of cartridge magazine 2 it is provided in the preferred design example that cartridges P in all regions are arranged directly adjacent to one another.

In support thereof, additional protrusions 15 and 18 are provided on inside surfaces 5*a* and 6*a* of both side walls 5 and 6 which are arranged in transitional region III along a first curved path 21 and a second curved path 22, wherein curved paths 21, 22 respectively each include a turning point 23, 24 and which extend from housing bottom side 7 (compare, for example, FIG. 1) to housing top side 8 (compare for example FIG. 1 or 4) before the respective turning point 23, 24 in direction of central plane M (compare FIG. 3 or 6) and which, after the respective turning point 23, 24 tightly fit against a first and a second parallel relative to central plane M which herein are formed by inside surfaces 5*a* and 6*a* of first and second side walls 5 and 6 in region II. Curved paths 21, 22 are designed symmetrically identical relative to central plane M, however first 21 and second curved path 22 are offset relative to one another in the Z-direction by an offset V. The selected offset V is between 7% and 35%, in particular between 10% and 25% and especially between 18% and 22% of the difference between distance B and distance C.

Figure 6:
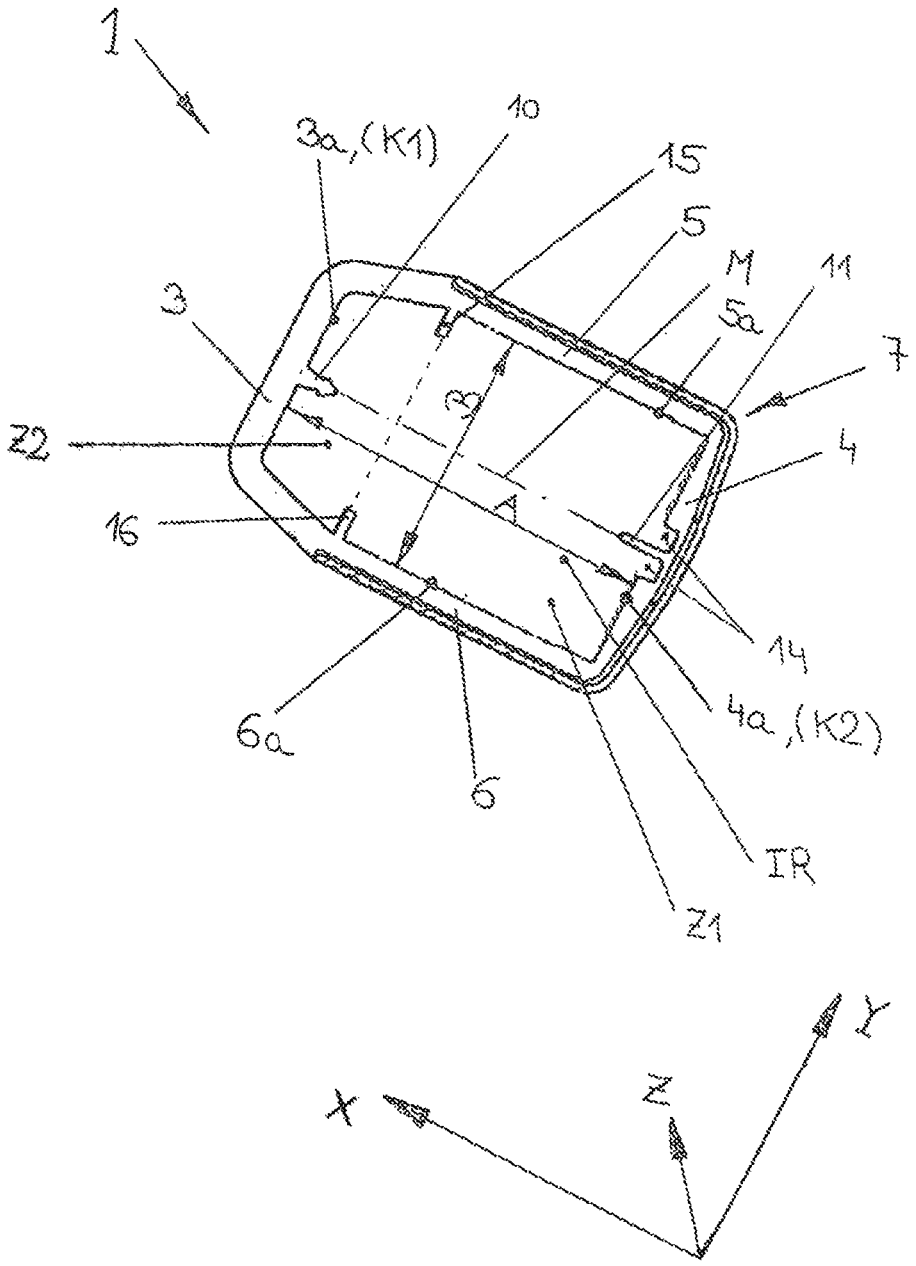
FIG. 6 is a view of the housing cross section in region I of FIG. 5.

From the cross sectional depiction of housing 1 in FIG. 6 it can be seen that housing 1 of cartridge magazine 2 that is illustrated in FIGS. 1 to 6 is a single component. Housing 1 should consist of a homogeneous material, wherein the structure of the material is substantially homogeneous over entire housing 1 and in this case consists of a synthetic material. The synthetic material should preferably consist of a polyamide. Since the cartridge magazine is designed to accommodate a high number of cartridges and provides preferably between 50 and 80 cartridges, for example 60 cartridges during operation of the firearm without having to change out the magazine, the cartridge magazine is provided as the first cartridge magazine also consisting of a polyether ether ketone (PEEK).

The illustrated cross section also shows that the cross section of the first region extending along the X-axis and the Y-axis divides itself into a rectangular zone Z1 and into a trapezoid zone Z2 adjoining rectangular zone Z1. The cross section of region II which is not again explicitly discussed is designed accordingly.

The illustration also shows that first protrusion 10, at least in sections, is arranged within central plane M and/or second protrusion 11 is arranged within central plane M, at least in sections.

The extension of the first protrusion 10 in the illustrated design example in the X-direction is between 5% of A and 30% of A, in particular between 5% of A and 18% of A and especially between 8% of A and 13% of A and/or that the extension of the second protrusion 11 in the X-direction is between 5% of A and 30% of A, in particular between 5% of A and 18% of A and especially between 8% of A and 13% of A.

FIG. 6 also shows, that inside surface 4*a* of rear wall 4 has two grooves 14 in at least one region I, II, or III, preferably even in all three regions I, II and III each of which progress laterally, preferably directly adjacent to second protrusion 11.

While this invention has been described with respect to at least one embodiment, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

COMPONENT IDENTIFICATION LIST

I First region
II second region
III third region
A distance A
B distance B
C distance C
IR interior space
K1 first circular path
K2 second circular path
M median plane
P cartridge(s)
V offset
Z1 rectangular zone
Z2 trapezoid zone
1 housing
2 cartridge magazine
3 front wall
3*a* inside surface of front wall
4 rear wall
4*a* inside surface of rear wall
5 first side wall
5*a* inside surface of first side wall
6 second side wall
6*a* inside surface of second side wall
7 bottom side of housing
8 top side of housing
9 magazine lip(s)
10 first protrusion
11 second protrusion
12 start of second protrusion
13 end of second protrusion
14 groove(s)
15 additional protrusion (of first side wall)
16 start of additional protrusion
17 end of additional protrusion
18 additional protrusion (of second side wall)
19 start of addition protrusion
20 end of additional protrusion
21 first curved path
22 second curved path
23 turning point
24 turning point
25 bottom cover
26 first feeder
27 second feeder
28 first spring
29 second spring
30 locking section
31 inside bottom plate
32 locking piece
33 clearance

What is claimed is:

1. A housing for a cartridge magazine for a firearm, which extends along an X-axis, a Y-axis and a Z-axis, comprising:

a front wall;

a rear wall;

a first side wall; and a second side wall, inside surfaces of the front wall, the rear wall, the first side wall and the second side wall forming an interior space consisting of a first region and a second region, between the first region and the second region a transitional region is formed which connects the first region and the second region with one another;

wherein the interior space is limited by the inside surfaces of the front wall, the rear wall, the first side wall and the second side wall;

wherein the inside surface of the front wall extends in the direction of the Z-axis in at least one of the regions along a first circular path;

wherein the inside surface of the rear wall extends in at least one of the regions in the direction of the Z-axis along a second circular path;

wherein the inside surfaces of the front wall and the rear wall in at least one of the regions are located at a first distance (A) from one another;

wherein the housing has a housing bottom side and a housing top side, magazine lips are formed on the housing topside, and the housing bottom side is designed to be at least partially open, the first region being configured for accommodating four stacks of cartridges arranged directly adjoining one other and being offset in the Z-direction relative to one another, the second region being configured for accommodating two stacks of cartridges arranged directly adjoining one another and being offset in the Z-direction relative to one another, wherein the inside surface of the front wall has a first protrusion which protrudes in direction of the X-axis into the interior space of the housing and extends along the Z-axis originating from the transitional region at least partially into the first region and also at least partially into the second region, and the inside surface of the rear wall has a second protrusion which protrudes in direction of the X-axis into the interior space of the housing and which along the Z-axis features a start in the first region and an end in the transitional region or in the second region.

2. The housing of claim 1, wherein the inside surfaces of the first side wall and the second side wall in the first region and in the second region are arranged substantially parallel relative to one another and between them in the Y-direction a virtual central plane is formed in the X- and the Z-directions.

3. The housing of claim 2, wherein a first protrusion is arranged at least in sections inside the central plane and/or a second protrusion is arranged at least in sections inside the central plane.

4. The housing of claim 3, wherein an extension of the first protrusion in the X-direction is between 5% of A and 30% of A, and/or an extension of the second protrusion in the X-direction is between 5% of A and 30% of A.

5. The housing of claim 3, wherein the inside surface of the rear wall has at least two grooves in at least one of the regions, each of the grooves progress laterally directly adjacent to the second protrusion.

6. The housing of claim 1, wherein the inside surfaces of the first side wall and the second side wall in the first region are located at a second distance (B) and in the second region at a third distance (C) from one another.

7. The housing of claim 6, wherein the second distance (B) is 1.85 times to 2.15 times that of the third distance (C).

8. The housing of claim 1, wherein a cross section of the first region extending along the X-axis and the Y-axis is divided into a rectangular zone and into a trapezoid zone adjoining the rectangular zone, and a cross section of the second region extending along the X-axis and the Y-axis is divided into a rectangular zone of the second region and into a trapezoid zone of the second region adjoining the rectangular zone of the second region.

9. The housing of claim 1, wherein the inside surface of the first side wall has a protrusion which protrudes in direction of the Y-axis into the interior space of the housing and which along the Z-axis has a start in the first region and ends in the transitional region, and/or the inside surface of the second side wall has a protrusion which protrudes in direction of the Y-axis into the interior space of the housing and which along the Z-axis has a start in the first region and ends in the transitional region.

10. The housing of claim 9, wherein the protrusion of the first side wall and/or the protrusion of the second side wall are arranged in an interface region between a rectangular zone and a trapezoid zone adjoining the rectangular zone of the cross section of first region.

11. The housing of claim 1, wherein the inside surface of the first side wall in the transitional region is along a first curved path and the inside surface of the second side wall in the transitional region is along a second curved path, wherein the curved paths each have a respective turning point and extend from the bottom side of housing to the top side of the housing before the respective turning point in direction of a central plane, the curved paths, after their respective turning point, respectively fit against a first and a second parallel relative to the central plane.

12. The housing of claim 11, wherein the curved paths are symmetrically identical.

13. The housing of claim 12, wherein the first and second curved paths are arranged in a Z-direction offset relative to one another by an offset (V).

14. The housing of claim 13, wherein the inside surfaces of the first side wall and the second side wall in the first region are located at a second distance (B) and in the second region at a third distance (C) from one another, the offset (V) is between 7% and 35% of the difference between the second distance (B) and the third distance (C).

15. The housing of claim 1, wherein the housing is a single component.

16. The housing of claim 1, wherein the housing consists of a homogeneous material, and the structure of the material is substantially homogeneous over the entire housing.

17. The housing of claim 1, wherein the housing consists of a synthetic material.

18. A method for operating a firearm, comprising the step of operating the firearm with a cartridge magazine with a housing of claim 1.

19. A cartridge magazine for a firearm, the cartridge magazine comprising:

a housing for the cartridge magazine which extends along an X-axis, a Y-axis and a Z-axis and which, in its inside forms an interior space consisting of a first region and a second region, wherein between the first region and the second region a transitional region is formed which connects the first and the second region with one another;

wherein the interior space is limited by inside surfaces of a front wall, a rear wall, a first side wall and a second side wall;

wherein the inside surface of the front wall extends in the direction of the Z-axis in at least one of the regions along a first circular path;

wherein the inside surface of the rear wall extends in at least one of the regions in the direction of the Z-axis along a second circular path;

wherein the inside surfaces of the front wall and the rear wall in at least one of the regions are located at a first distance (A) from one another;

wherein the housing has a housing bottom side and a housing top side, magazine lips are formed on the housing topside and the housing bottom side is at least partially open;

wherein the cartridge magazine includes a bottom cover which is suitable to at least substantially close off the at least partially open bottom side of the housing;

a first feeder;

a second feeder; the feeders allowing the second feeder to be movable at least partially into a space of the first feeder;

a first spring located between the first feeder and the bottom cover; and a second spring located between the first feeder and the second feeder, the first region accommodating four stacks of cartridges arranged directly adjoining one other and offset in a Z-direction relative to one another, and the second region accommodating two stacks of cartridges arranged directly adjoining one another and offset in the Z-direction to one another, wherein the inside surface of the front wall has a first protrusion which protrudes in direction of the X-axis into the interior space of the housing and extends along the Z-axis originating from the transitional region at least partially into the first region and also at least partially into the second region, and the inside surface of the rear wall has a second protrusion which protrudes in direction of the X-axis into the interior space of the housing and which along the Z-axis features a start in the first region and an end in the transitional region or in the second region.

* * * * *